United States Patent [19]

Nezworski

[11] Patent Number: 4,685,598

[45] Date of Patent: Aug. 11, 1987

[54] KEG VALVE ASSEMBLY IMPROVED FOR FAST FILLING

[75] Inventor: James E. Nezworski, Waukesha, Wis.

[73] Assignee: The Perlick Company, Milwaukee, Wis.

[21] Appl. No.: 902,632

[22] Filed: Sep. 2, 1986

[51] Int. Cl.[4] ..... B65D 83/06; B65B 1/04

[52] U.S. Cl. ..... 222/400.7; 141/113; 141/286; 141/302; 141/348

[58] Field of Search ..... 222/400.7, 402.16, 564; 251/118; 141/286, 113, 302, 348; 239/499, 524

[56] References Cited

U.S. PATENT DOCUMENTS

| | | | |
|---|---|---|---|
| 3,156,252 | 11/1964 | Johnston | 222/400.7 |
| 3,880,182 | 4/1975 | Johnston | 222/400.7 |
| 4,079,762 | 3/1978 | Hanson, Jr. | 141/286 |
| 4,343,325 | 8/1982 | Fallon | 222/400.7 X |
| 4,351,456 | 9/1982 | Nezworski | 222/400.7 |
| 4,363,336 | 12/1982 | Cerrato | 222/400.7 X |
| 4,488,572 | 12/1984 | Brown et al. | 222/400.7 X |
| 4,509,663 | 4/1985 | Fallon | 222/400.7 |

*Primary Examiner*—Joseph J. Rolla
*Assistant Examiner*—Gregory L. Huson
*Attorney, Agent, or Firm*—James E. Nilles; James R. Custin

[57] ABSTRACT

In a valve assembly receivable in an outwardly projecting neck in a keg, for normally sealing the keg and for cooperation with a detachable coupler by which the keg is tapped, the cylindrical spring retainer of the assembly has at its axially inner end deflector surfaces so liquid flowing inward along that cylindrical wall during filling of the keg through the gas passage of the valve assembly is deflected radially across the inner end edge of that wall as a sheet-like jet. This prevents upward spray out of the annular space between the siphon tube and the spring retainer, thus preventing overcarbonation, excessive foaming and underfilling of the keg.

12 Claims, 7 Drawing Figures

KEG VALVE ASSEMBLY IMPROVED FOR FAST FILLING

FIELD OF THE INVENTION

This invention relates to keg valve assemblies of the type that provide for normally sealing a keg and for cooperation with a detachable tapping coupler through which liquid can be drawn from the keg and pressure gas can be charged into it; and the invention is more particularly concerned with improvements in such a valve assembly whereby a keg equipped with it can be very quickly filled with liquid without danger that the liquid will be overcarbonated or will foam excessively or that the keg will be underfilled.

BACKGROUND OF THE INVENTION

The type of valve assembly to which the present invention generally relates is familiar to both the brewing and tavern industries. It comprises an annular valve body that is detachably secured in an outwardly projecting neck surrounding an opening in a keg. Cooperating with the valve body to define an annular gas passage is a coaxial annular gas valve member that is movable axially inwardly and outwardly relative to the valve body, from and to a position in which the gas valve member engages a seat on the valve body to seal the gas passage. Coaxially fixed to the annular gas valve member is an elongated siphon tube that projects inwardly from it and defines a liquid passage through which liquid can be forced out of the keg under the pressure of gas admitted through the gas passage. When the valve assembly is not connected with a filling mechanism or a tapping coupler, the liquid passage is sealed at its outer end by a liquid valve member that is biased outwardly into engagement with a seat on the inner periphery of the annular gas valve member. A tapping coupler detachably connectable with this valve assembly holds open the gas and liquid valves and provides for conducting gas from a pressurized source to the gas passage and for conducting liquid from the liquid passage to a tap at which it can be drawn for dispensing.

Keg valve assemblies of the type here under consideration have been the subject of more or less constant inventive and developmental activity for many years, as is evident from the substantial body of patent literature on such devices. This prior activity has focused almost exclusively on those aspects of the valve assembly that relate to its functions as a seal for the keg and as a device cooperable with a tapping coupler for drawing liquid out of the keg. However, little attention has been given to problems posed by such a valve assembly in the filling of a keg in which it is installed, although the brewing industry has for some time been aware of the existence of those problems. Specifically, brewers have found that a keg equipped with a conventional valve assembly must be filled with beer at a very slow rate during the initial stages of the filling operation in order to avoid overcarbonation and foaming of the product and consequent underfilling of the keg. Because of this slow filling rate, the keg filling operation tends to be a bottleneck which limits the output capacity of a brewery. Research has established that the heretofore conventional keg valve assembly is responsible for the restriction on filling rate, but the industry concerned with the manufacture of such assemblies has heretofore been unable to solve the problem.

In preparation for filling, a keg is first washed, rinsed and cooled and is then charged with carbon dioxide gas to purge it of steam and air. From the time it is delivered to the washing stand, through the filling operation, the keg is oriented with its neck lowermost so that the siphon tube projects upward from the valve assembly. At the filling stand the gas and liquid valves of the valve assembly are held open and beer is charged into the keg through the gas passage. Meanwhile, the siphon tube serves as a standpipe through which carbon dioxide leaves the keg as it is displaced by the incoming beer. Filling is automatically terminated as soon as the entry of beer into the siphon tube is detected by a sensor.

With prior keg valve equipment, if beer was delivered into the keg at a high flow rate during the initial stages of filling, it tended to issue from the valve assembly into the keg interior as upwardly directed jets or sprays. These presented large surface areas at which the carbon dioxide in the keg was absorbed. With such overcarbonation and agitation the beer foamed vigorously. Foam would then enter the siphon tube, causing filling to terminate well before the level of unfrothed beer reached the upper end of the siphon tube, and consequently the keg would be underfilled. To prevent such overcarbonation and underfilling, it was necessary to hold the inflow of beer to a very low rate until the keg had been filled to a level well above the valves of the keg valve assembly. From that point jetting and spraying were suppressed by beer already filled into the keg, and the inflow could be increased to the full rate available with the filling equipment. Obviously, the prolonged initial period of low inflow rate played a major role in determining the time required for complete filling of a keg.

A major cause of jetting and spraying at high initial filling rates was the portion of the valve assembly that provides for biasing the annular gas valve member to its closed position. This comprises a coiled expansion spring that surrounds the siphon tube and a spring retainer having a cylindrical wall that surrounds the coiled spring in coaxial, radially spaced relation to it and to the siphon tube. At its axially outer end the spring retainer is coaxially secured to the annular valve body that is seated in the keg neck; at its axially inner end the spring retainer provides a seat or abutment against which the inner end of the coiled spring reacts. The outer end of the coiled spring is of course engaged with the gas valve member to bear axially outwardly against it. The annular gas passage, which is jointly defined by the annular valve body and the annular gas valve member and through which beer enters the valve assembly, opens axially inwardly to the annular space between the cylindrical spring retainer wall and the siphon tube.

Because of the geometry of the gas passage, beer passing out of it into the annular space just mentioned tends to flow mainly along the cylindrical spring retainer wall, especially at high inflow rates. To allow the incoming beer to pass out of that space, there are large holes in the cylindrical wall. Some portion of the incoming beer does in fact pass through those holes at all flow rates, but especially at high flow rates a substantial portion of it continues in axial flow along the cylindrical wall, and with prior valve assemblies it was this axial flow component that mainly gave rise to jets and sprays.

The spring seat at the inner end of the cylindrical spring retainer wall comprises radially inward projections that are usually formed in one piece with the wall itself. In some valve assemblies these projections are relatively large and the spring directly engages them, in others they comprise relatively small tabs that are overlain by a washer-like spring seat member. In those devices wherein the spring seat comprises a washer, there were usually small spaces between it and the cylindrical wall through which beer tended to issue in upward jets and sprays. In all cases there has been some substantial clearance between the spring seat and the siphon tube, needed for purposes of manufacture and servicing, and through this clearance space there has also been a substantial upward jetting and spraying of beer at high inflow rates. In all cases, too, beer tended to issue from the holes in the cylindrical spring retainer wall with a certain amount of splattering and spraying.

Attempts have been made to minimize spraying, jetting and turbulence during the initial stages of filling at high flow rates by modifying the geometry of the holes in the cylindrical spring retainer wall. These efforts have resulted in no more than insignificant improvement.

Since the flow of beer upwardly between the spring retainer and the siphon tube is mainly along the cylindrical spring retainer wall, an attempt has been made to control upward jetting and spraying in one widely used keg valve assembly by so forming the spring seat at the axially inner end of the spring retainer as to dead-end the axial flow at that point and thus force the incoming beer out through the holes in the spring retainer wall. With this arrangement, however, there necessarily remained a clearance space around the siphon tube, and much of the flow along the cylindrical wall was simply diverted radially inwardly to this outlet, from which it issued as a strong upwardly directed jet. The arrangement thus provided only a minor decrease in the time required for filling a keg.

The present invention takes an approach to the problem that is essentially the opposite of the one just described. It begins from the premise that a strong axially upward flow along the cylindrical spring retainer wall is inevitable at high inflow rates and that little or nothing can be gained by attempting to block or suppress that flow at the axially inner end of the spring retainer in the hope of converting it to a static pressure that will compel outflow through the holes in the cylindrical spring retainer wall. Instead, the present invention contemplates a controlled debouchment at the inner end of the spring retainer whereby turbulence is minimized and whereby the debouched liquid is so directed that jetting and spraying are suppressed as soon as the level of beer in the keg has risen to slightly above the axially inner end of the spring retainer, so that a reduced inflow rate need be maintained for only a few seconds and filling can thereafter proceed at the maximum rate available from the filling equipment.

SUMMARY OF THE INVENTION

The general object of this invention is to provide improvements in a keg valve assembly of the character described whereby beer filled into a keg in which the assembly is installed, forced upwardly through the gas passage in the assembly, is caused to issue from the valve assembly substantially horizontally and radially away from the siphon tube, so that within a very few seconds after filling has started the incoming jets of beer are below the surface of the non-flowing beer in the keg and therefore cannot give rise to overcarbonation or foaming.

Thus the ultimate object of this invention is to provide an improved keg valve assembly that enables a keg to be filled in substantially less time than has heretofore been required, without overcarbonation or excessive foaming of the keg contents and without danger that the keg will be underfilled.

Another object of the invention is to provide, in a keg valve assembly of the character described, a combination spring seat and deflector whereby beer or the like that is being filled into a keg equipped with the valve assembly is permitted to issue across the axially inner end of the cylindrical spring retainer wall in a controlled debouchment, being deflected into a substantially horizontal flow sheet which moves radially away from the siphon tube and which deflects any upward spray that may issue from the holes in said cylindrical wall, said flow sheet being at a level to be soon immersed in the non-flowing liquid that has been filled into the keg so that thereafter only a substantially quiescent surface is presented to gas in the keg.

Another and more specific object of the invention is to provide, for a keg valve assembly of the character described, a substantially ring-shaped element that serves both as a readily removable seat for the coiled spring that biases the gas valve member of the assembly to its closed position and as a debouchment control for liquid being forced upwardly through the gas valve of the assembly during filling of a keg in which the assembly is installed, whereby the liquid is constrained to issue from the assembly in substantially horizontal flow even at high filling rates.

These skilled in the art will recognize from the following description of the invention that another of its objects is to provide means that can be readily and inexpensively incorporated into existing conventional keg valve assemblies for so modifying them as to make them capable of achieving the objectives of this invention.

In general, these and other objects of the invention are achieved in a valve assembly for normally sealing a keg, of the type cooperable with a detachable tapping coupler that provides for drawing liquid from the keg and admitting pressure gas into it, said valve assembly comprising an annular valve body detachably securable in an outwardly projecting neck on a keg, an annular gas valve member cooperating with the valve body to define an annular gas passage and movable in inward and outward directions respectively from and toward an engagement with the valve body that seals the gas passage, a siphon tube through which liquid passes out of the keg and which has an axis that coincides with axes of the valve body and the gas valve member, said siphon tube being secured to said gas valve member and projecting in said inward direction therefrom, a coiled spring surrounding the siphon tube and bearing against the gas valve member to bias it towards said engagement, a spring retainer having a cylindrical wall which surrounds the spring in coaxial radially spaced relation to the siphon tube and which has an outer end that is secured to said valve body and an opposite inner end, said spring retainer further having abutment means on said inner end of the cylindrical wall against which said spring reacts. The invention provides debouchment controlling means for minimizing turbulence of liquid forced through said gas passage for filling a keg in which the valve assembly is installed and which has its neck lowermost. Said debouchment controlling means is characterized by deflection means connected with a portion of the valve assembly that is spaced in said inward direction from said valve body and defining surface areas which are substantially normal to said axes and which face substantially in said outward direction. Said surface areas are spaced in said inward direction from circumferentially extending edge portions of said cylindrical wall at said inner end thereof to cooperate with those edge portions in defining outlets, and they have substantially regular circumferential distribution around the siphon tube and extend radially from the siphon tube substantially across the annular space between it and said cylindrical wall. By this deflection means liquid that flows in said inward direction in said annular space is deflected to flow through said outlets across said edge portions of the cylindrical wall in directions substantially radial to said axes.

In one preferred embodiment of the invention said cylindrical wall has on its inner end a plurality of radially inwardly projecting, circumferentially spaced, coplanar tabs that comprise said abutment means, and the deflection means comprises a ring having substantially flat and coplanar deflector segments that define said surface areas, circumferentially alternating with substantially flat and coplanar spring seat segments which are in axially offset relation to said deflector segments and are connected with the latter by axially extending portions of the ring, there being a spring seat segment for each of said tabs. Each said spring seat segment has a circumferential magnitude at least equal to that of its tab, has a radial magnitude substantially equal to the distance between the siphon tube and said cylindrical wall, and is confined between its tab and said spring to be maintained in engagement with its tab by the reaction force of the spring.

In another embodiment of the invention, particularly suitable for modifying existing keg valve assemblies, the debouchment controlling means is formed in one piece with the spring retainer.

BRIEF DESCRIPTION OF DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
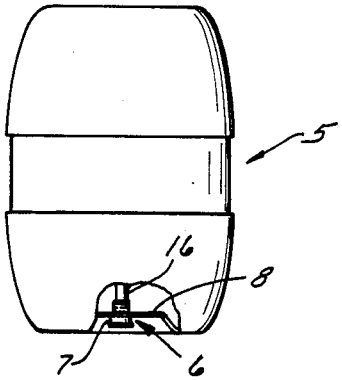
FIG. 1 is a side view of a keg in which a valve assembly of this invention is installed, a portion of the keg being shown cut away to disclose the valve assembly.

A keg 5 wherein there is installed a valve assembly 6 of the general type to which this invention relates has an annular outwardly projecting neck 7 which is fixed to one wall 8 of the keg and which surrounds an opening in that wall. The valve assembly 6 comprises an annular valve body 9 that is removably secured in the keg neck 7 in sealed relation to it, as by means of an annular spring clip 10 which is received in a radially inwardly opening circumferential groove in the keg neck, near its axially outer end, and which overlies an axially outwardly facing surface on the valve body.

Coaxial with the valve body 9 and movable axially outward and inward, towards and from seating engagement with it, is an annular gas valve member 12 which cooperates with the valve body to define an annular gas passage 14 that is sealed at its outer end by the seating of the gas valve member against the valve body 9. Coaxially fixed to the gas valve member and projecting inwardly from it is a siphon tube 16 that extends across the interior of the keg to have its inner end spaced only a small distance from the keg wall that is opposite the neck 7. The siphon tube 16 and the annular gas valve member 12 together define a central liquid passage 17 through which liquid passes out of the keg when the keg is tapped. The liquid passage is normally closed at its outer end by a liquid valve member 19 that is biased axially outwardly for sealing engagement against a seat on the inner periphery of the annular gas valve member 12.

As is well known, the contents of a keg equipped with a valve assembly of the type here under consideration can be drawn off by means of a tapping coupler (not shown) which is detachably connected to the valve body 9, in sealed relation to it, and which is arranged for holding the gas valve member 12 and the liquid valve member 19 off of their respective seats. One type of tapping coupler cooperable with a valve assembly of the type here under consideration is disclosed in U.S. Pat. No. 4,350,273 to Nezworski et al, which has a common assignee with this application. When a tapping coupler is connected to the valve assembly, the keg is normally oriented with its neck 7 uppermost and with the siphon tube 16 projecting downwardly in the keg. Through the coupler, pressure gas is charged into the keg by way of the annular gas passage 14, and gas pressure drives liquid in the keg upwardly through the siphon tube 16 and onward to a tap (not shown) that is connected with the coupler.

When the keg is being filled it is oriented with its neck 7 lowermost so that the siphon tube 16 then projects upwardly from the valve assembly. The automatic keg filling apparatus that is conventionally used has a tubular probe 21 that makes coaxial sealing engagement with the annular gas valve member 12 to hold that member off of its seat so that liquid can be forced into the keg through the annular gas passage 14. At the same time, a central probe (not shown) of the filling apparatus holds the liquid valve member 19 off of its seat. With the liquid valve open, gas previously filled into the keg and displaced by the incoming liquid can flow out of the keg through the liquid passage 17 that is conjointly defined by the siphon tube 16 and the annular gas valve member 12. During the filling operation, the upright siphon tube 16 functions as a standpipe that controls the maximum level to which the keg can be filled. Filling is terminated as soon as liquid begins to enter the upper end of the siphon tube, but, as pointed out above, the keg will be underfilled if there is a substantial depth of foam on the surface of liquid in the keg, since such foam, upon entering the siphon tube, will cause filling to be terminated before the unfrothed liquid level reaches the inner end of the siphon tube.

For an understanding of the present invention and the manner in which it expedites keg filling, attention is now directed to the structure whereby the annular gas valve member 12 is biased outwardly towards seating engagement against the annular valve body 19. That structure comprises a coiled expansion spring 23 and a spring cage or spring retainer 24. The spring 23 surrounds the siphon tube 16 and has an outer end that bears against the gas valve member 12 and an inner end that reacts against the spring retainer 24. In this case the outer end of the spring 23 engages a circumferential, axially inwardly facing shoulder 25 on the siphon tube 16, defined by a coaxial enlarged diameter outer end portion 26 of that tube which tightly embraces the gas valve member 12 to provide a sealed connection to it.

The spring retainer comprises a cylindrical wall 27 that has an outer end concentrically fixed to the annular valve body 9 and has abutments 28 at its inner end that receive the reaction force of the spring 23. The cylindrical wall 27 coaxially surrounds the spring 23 and the siphon tube 16 in radially outwardly spaced relation to both of them.

Figure 2:
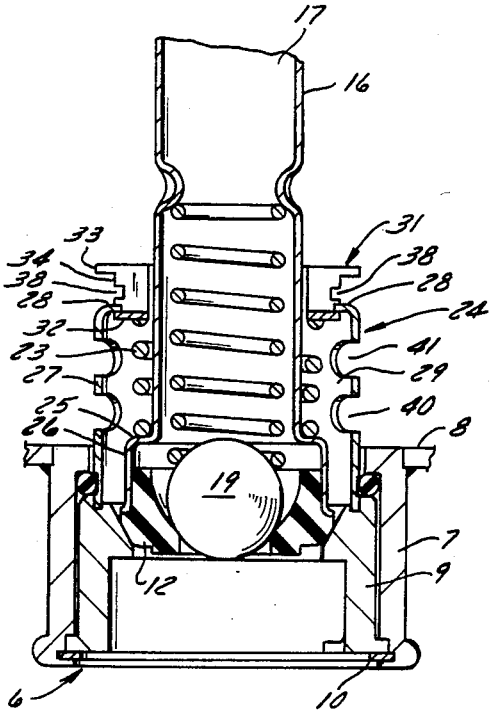
FIG. 2 is a view in longitudinal section of a valve assembly that incorporates one embodiment of the invention.
Figure 3:
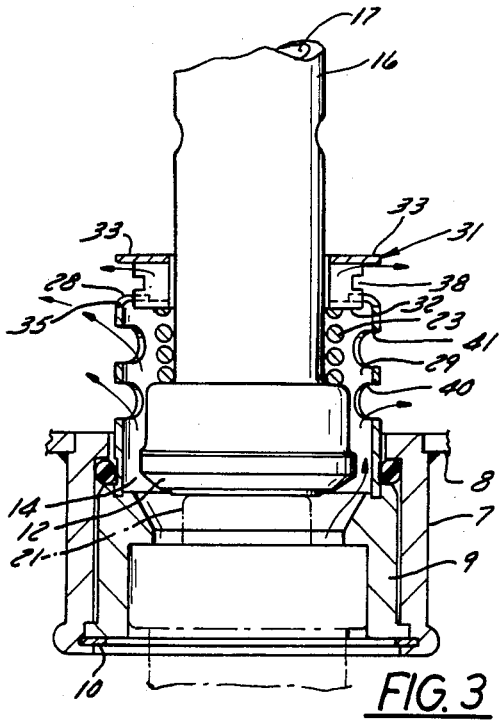
FIG. 3 is a view of the valve assembly of FIG. 2, partly in side elevation and partly in longitudinal section, showing liquid flow paths during filling of a keg in which it is installed.

As can be seen from FIGS. 2 and 3, the axially outer portion of the gas valve member 12, which cooperates with the seat on the inner periphery of the valve body 9, is frustoconical, tapering in the axially outward direction; and the inner periphery of the valve body 9, which defines the gas valve seat, is similarly frustoconical. Because of this geometry, liquid forced inwardly in the annular gas passage 14 tends to emerge from it into the annular space 29 between the siphon tube 16 and the cylindrical spring retainer wall 27 as a divergent jet, which is to say that it is directed towards said cylindrical wall 27 and, in the main, tends to flow inwardly along that wall. There is some escape of beer from the annular space 29 through apertures 40 and 41 in the cylindrical wall 27 that are described below; but, especially at high inflow rates, a substantial portion—probably a major portion—of the incoming beer flows inwardly along the full length of that wall. The present invention takes account of that flow pattern.

Figure 4:
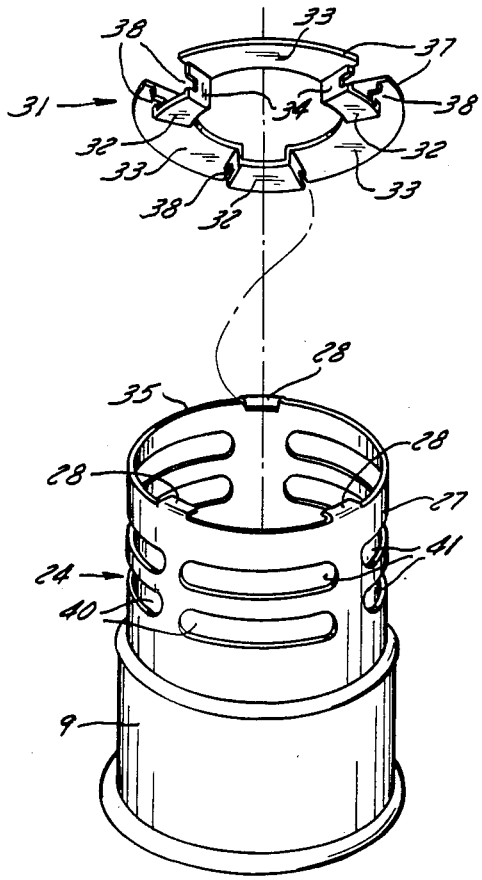
FIG. 4 is a disassembled perspective view of the valve body, spring cage and spring seat washer in the valve assembly of FIGS. 2 and 3.

In the valve assembly shown in FIGS. 2–4, the abutments 28 at the inner end of the cylindrical spring retainer wall comprise lugs or tabs that project radially inwardly through a small distance from that wall, and they are formed in one piece with it. These tabs all lie in a single plane and are preferably identical with one another, being spaced apart at uniform circumferential intervals. Each of the spaces between tabs has a circumferential magnitude substantially greater than the circumferential magnitude of a tab. Cooperating with the tabs 28 to provide a spring seat and a debouchment controlling deflector is a ring 31 that can be formed in one piece.

The ring 31 has a plurality of circumferentially spaced spring seat segments 32, one for each of the tabs 28, alternating circumferentially around the ring with deflector segments 33. The spring seat segments 32 are flat and coplanar with one another. The deflector segments 33 are likewise flat and coplanar, but they are in axially offset relation to the spring seat segments 32, and the ring has edgewise axially extending portions 34 that connect its spring seat segments with its deflector segments.

When the ring 31 is assembled with the spring retainer, each of the spring seat segments 32 overlies one of the tabs 28, being confined between its tab and the inner end of the spring 23 and maintained in firm engagement with its tab by the reaction force of the spring; and the deflector segments 33 are spaced in the inward direction relative to the keg from the inner end edge 35 of the cylindrical spring retainer wall. The ring 31 has a pair of connecting portions 34 for each spring seat segment 32, extending from the circumferentially opposite ends of the spring seat segment; and these two connecting portions are spaced apart by a distance equal to, or slightly greater than, the circumferential magnitude of the tab 28 overlain by the spring seat segment; hence these connecting portions normally cooperate with the circumferentially opposite ends of the tab between them to confine the ring 31 against rotation relative to the spring retainer 24. Each spring seat segment 32 extends radially substantially entirely across the space 29 between the siphon tube 16 and the cylindrical wall 27 and thus cooperates with its pair of connecting portions 34 in diverting portions of the liquid flowing along the cylindrical wall into flow towards its circumferentially adjacent deflector segments 33.

Each deflector segment 33 is of such radial magnitude as to extend substantially entirely across the distance between the siphon tube and the cylindrical spring retainer wall. The arcuate outer edges 37 of the deflector segments, which are concentric to the axis of the ring 31, should be at the largest feasible radius to that axis, but that radius cannot be significantly greater than the outside radius of the cylindrical spring retainer wall 27 so that the ring will not interfere with insertion of the valve assembly into a keg.

Each of the axially extending connecting portions 34 of the ring extends edgewise across substantially the entire distance between the siphon tube 16 and the cylindrical spring retainer wall 27. Each connecting portion thus has a substantially straight axially extending outer edge, but there is a small notch 38 in that edge which provides for assembly of the ring with the spring retainer. Thus the ring 31 is initially inserted axially into the spring retainer, against the bias of the spring 23, with the ring in an orientation such that its spring seat segments 32 are between the tabs 28 on the spring retainer. The ring is then rotated to bring the spring seat segments into their positions for engagement with the tabs 28, and for such rotation the radially inner edge portions of the tabs are received in the notches 38 in the connecting portions 34.

Since each deflector segment 33 presents to liquid flowing inward along the cylindrical wall 27 a surface which faces axially in the outward direction relative to the keg and which lies in a plane normal to the siphon tube axis, the deflector segment has the effect of deflecting such flow into a direction radial to the siphon tube and across the inner end edge 35 of the cylindrical wall 27. It will be seen that each deflector segment 33 cooperates with the axially extending ring portions 34 that are connected with it, and also with the inner end edge 35 of the cylindrical wall 27, to define a spout that opens in a radially outward direction from the annular space 29 between the siphon tube 16 and the cylindrical wall; and all liquid which arrives at the inner end portion of the cylindrical wall is constrained to pass through the spouts thus defined by the several deflector segments.

Preferably the distance between the deflector segments 33 and the inner end edge 35 of the cylindrical wall 27 is between about 3/16 inch (4.75 mm) and $\frac{1}{4}$ inch (6.5 mm).

During filling of the keg, the liquid issuing from the spouts defined by the deflector segments 33 takes the form of horizontal sheet-like jets that are directed radially away from the cylindrical spring retainer wall. It will be apparent that as soon as the body of liquid in the keg rises to a level only slightly above that of the deflector segments 33, the jets just described are discharged into that body of liquid and therefore only a relatively quiescent liquid surface is presented to gas in the keg. To minimize foaming, liquid is preferably forced into the keg at a reduced rate until this critical liquid level is reached, but it is attained very early in the filling process, and thereafter filling can progress at the highest available rate.

The slot-like apertures 40 and 41 in the cylindrical spring retainer wall are elongated in the direction around that wall and are relatively narrow. They are arranged in two axially spaced apart zones, the apertures 41 in the axially inner zone being near the inner end of the spring retainer and the apertures 40 in the axially outer zone being closely adjacent to the valve body 9. With the valve assembly in its orientation for washing and filling of the keg, the apertures 40 in the axially outer zone thus have their lower edges very close to the bottom of the keg, to provide for total drainage of cleansing liquids through the gas passage.

The apertures 40, 41 are narrow in the direction along the axis of the valve assembly so that during filling their upper edges can serve as deflectors whereby liquid escaping from the spring retainer through those apertures, and which would otherwise tend to leave them at steeply upward inclinations, will be deflected for more nearly horizontal ejection. Even with the geometry just described for the apertures 40 and 41, liquid is ejected from them at some upward inclination, but such upwardly ejected spray is deflected or baffled by the sheet-like horizontal and radially outwardly ejected jets produced by the debouchment control ring 31. The deflection capabilities of these sheet-like jets have been established by actual tests with the valve assembly installed in an open chamber. Even at maximum inflow rates, there was no perceptible spray at levels above the deflector segments 33 of the ring 31, whereas with a prior conventional valve assembly abundant spray was ejected to well above the upper end of the siphon tube even at moderate flow rates. To ensure that the sheet-like jets issuing from the debouchment control means will perform their baffling or deflecting function, the apertures 40 and 41 in the cylindrical spring retainer wall are confined to zones that are axially aligned with the deflector segments, so that spray issuing from every aperture 40, 41 will be overlain by a jet issuing from a spout comprising a deflector segment.

Figure 6:
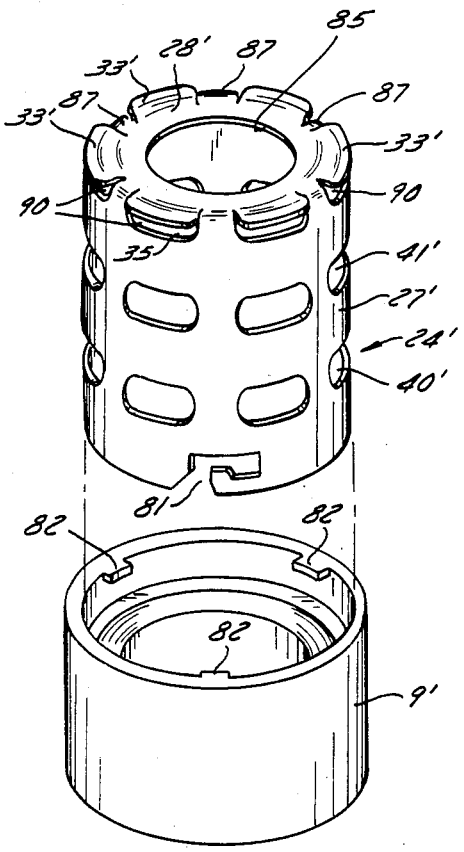
FIG. 6 is a view generally like FIG. 4 but illustrating the second embodiment.
Figure 7:
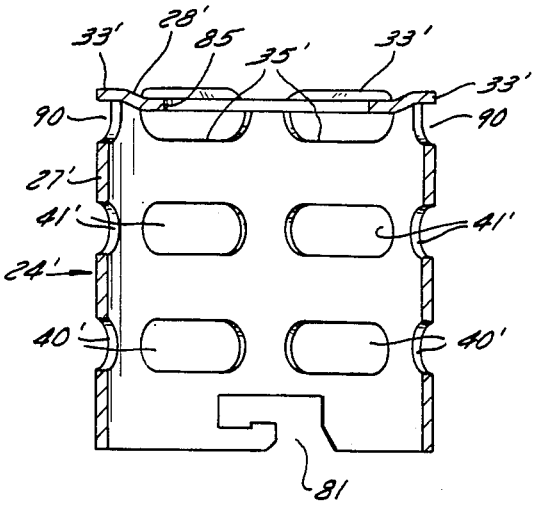
FIG. 7 is a view in longitudinal section of the spring retainer of the second embodiment.
Figure 5:
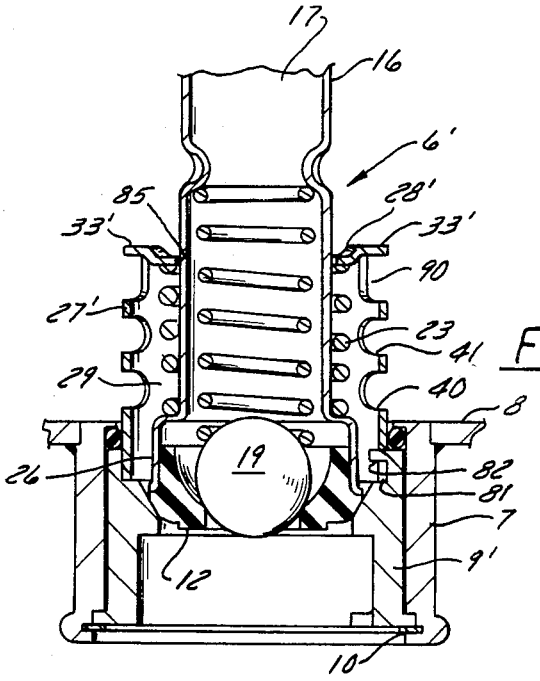
FIG. 5 is a view generally similar to FIG. 2 but illustrating a second embodiment of the invention.

The embodiment of the invention that is illustrated in FIGS. 5–7 provides for modification of a commercially used type of keg valve assembly 6' to incorporate the invention into it. Thus breweries that have their kegs equipped with such assemblies can obtain the benefits of this invention at low cost by replacement of only the spring retainer of each assembly.

In a keg valve assembly 6' of the type for which this second embodiment of the invention is intended, the spring retainer 24' is made in one piece, having on the inner end of its cylindrical wall 27' an integral, radially inwardly projecting circumferential flange 28' that serves as the seat for the coiled spring 23 surrounding the siphon tube 16. To provide for installation and removal of that coiled spring, the spring retainer 24' is detachably connected to the annular valve body 9' that is secured in the keg neck.

The replacement spring retainer 24' for such an assembly has the same provision as the original for detachable connection to the annular valve body 9', namely L-shaped bayonet connection slots 81 at the outer end of its cylindrical wall 27', adapted to receive radially inwardly projecting bayonet protuberances 82 on the inner periphery of the annular valve body 9'. The radially inwardly projecting circumferential flange 28' that provides the seat for the coiled spring 23 has a circular inner edge 85 that is concentric to the cylindrical wall 27' and is of a diameter to receive the siphon tube 16 with adequate clearance for easy assembly and disassembly.

The deflector segments 33' in this embodiment comprise circumferentially spaced apart portions of the flange 28', each of which extends circumferentially around a portion of the flange. The radially outer portions of the several deflector segments lie in a common plane that is normal to the axis of the cylindrical wall 27', while their radially inner portions are slightly offset in the axial direction towards the outer end of that wall, to be coplanar with portions 87 of the flange which intervene between the deflector segments and which join the cylindrical wall around a bend radius, as can be seen in FIGS. 6 and 7. Adjacent to each deflector segment is an elongated aperture 90 in the spring retainer which extends lengthwise circumferentially around the cylindrical wall 27'. Each deflector segment is in part struck out of its adjacent aperture 90 in the forming of the spring retainer and thus defines one longitudinal edge of that aperture. An opposite longitudinal edge 35' of the aperture, which comprises an inner end edge portion of the cylindrical wall, extends parallel to the axially adjacent deflector segment and is spaced from it by about 3/16 inch (4.75 mm) to $\frac{1}{4}$ inch (6.5 mm).

It will be apparent that each deflector segment 33' defines with its adjacent aperture 90 an outlet from the annular space 29 between the siphon tube and the cylindrical wall. As in the first described embodiment of the invention, each deflector segment 33' deflects liquid flowing in the inward direction in said annular space into flow radially away from the siphon tube through its adjacent aperture 90, causing the deflected fluid to issue from that aperture as a sheet-like jet.

The cylindrical wall 27' of the spring retainer 24' has holes 40' and 41' therein that have the same relation to the deflector segments 33' that the holes 40 and 41 have to the deflector segments 33 in the first described embodiment.

From the foregoing description taken with the accompanying drawings, it will be apparent that this invention provides simple and inexpensive improvements in a keg valve assembly whereby a keg in which the assembly is installed can be filled with liquid much more quickly than has heretofore been possible, without danger that the liquid will be overcarbonated or will foam excessively or that the keg will be underfilled. It will also be apparent that the invention can be incorporated into existing conventional keg valve assemblies as an inexpensive and easily installed modification.

What is claimed as the invention is:

1. In a valve assembly for normally sealing a keg, of the type cooperable with a detachable tapping coupler that provides for drawing liquid from the keg and admitting pressure gas into it, said valve assembly comprising an annular valve body detachably securable in an outwardly projecting neck on a keg, an annular gas valve member cooperating with the valve body to define an annular gas passage and movable in inward and outward directions respectively from and to an engagement with the valve body that seals the gas passage, a siphon tube through which liquid passes out of the keg and which has an axis that coincides with axes of the valve body and the gas valve member, said siphon tube being secured to said gas valve and projecting in said inward direction therefrom, a coiled spring surrounding the siphon tube to bias the gas valve towards said engagement, and a spring retainer having a cylindrical wall which surrounds the spring in coaxial radially spaced relation to the siphon tube and which has an outer end that is secured to said valve body and an opposite inner end, said spring retainer further having abutment means on said inner end of the cylindrical wall against which said spring reacts, debouchment controlling means for minimizing turbulence of liquid forced through said gas passage and entering a keg in which the valve assembly is installed and which has its neck lowermost, said debouchment controlling means being characterized by: deflection means connected with a portion of the valve assembly that is spaced in said inward direction from said valve body and defining surface areas which are substantially normal to said axes and which face substantially in said outward direction, said surface areas (1) being spaced in said inward direction from circumferentially extending edge portions of said cylindrical wall at said inner end thereof to cooperate with those edge portions in defining outlets, (2) having substantially regular circumferential distribution around the siphon tube, and (3) extending radially from the siphon tube substantially across the annular space between it and said cylindrical wall, whereby liquid that flows in said outward direction in said annular space is deflected to flow through said outlets and across said edge portions of the cylindrical wall in directions substantially radial to said axes.

2. The valve assembly of claim 1, further characterized in that said cylindrical wall has elongated holes therethrough which are spaced in said inward direction from said edge portions, extend lengthwise circumferentially and are confined to axially extending zones, each of which zones is axially aligned with one of said surface areas.

3. The valve assembly of claim 1 wherein said deflection means is connected with said cylindrical wall, and said surface areas defined by the deflection means are coplanar and are spaced in said inward direction from said edge portions of the cylindrical wall by a distance of between about 3/16 inch and about ¼ inch.

4. The valve assembly of claim 1 wherein said spring retainer is detachably secured to said valve body and wherein said abutment means and said deflection means are formed in one piece with said cylindrical wall and comprise radially inturned portions of the spring retainer at said inner end of the cylindrical wall, said outlets being defined by apertures in the spring retainer which are adjacent to said inturned portions, are elongated in the direction around the circumference of the cylindrical wall, and define said circumferentially extending edge portions of the cylindrical wall.

5. The valve assembly of claim 1 wherein said cylindrical wall has on its inner end a plurality of radially inwardly projecting, circumferentially spaced, coplanar tabs that comprise said abutment means, further characterized in that:

said deflection means comprises a ring having substantially flat and coplanar deflector segments that define said surface areas, circumferentially alternating with substantially flat and coplanar spring seat segments which are in axially offset relation to said deflector segments and are connected with the latter by axially extending portions of the ring, there being a spring seat segment for each of said tabs, each said spring seat segment (1) having a circumferential magnitude at least equal to that of its tab, (2) having a radial magnitude substantially equal to the distance between the siphon tube and said cylindrical wall, and (3) being confined between its tab and said spring to be maintained in engagement with its tab by the reaction force of the spring.

6. The valve assembly of claim 5 wherein each of said spring seat segments is connected with its circumferentially adjacent deflector segments by a pair of edgewise axially and radially extending portions of the ring which oppose circumferentially opposite end edges of the tab engaged by the spring seat segment to cooperate with those end edges in confining the ring against rotation relative to said cylindrical wall.

7. The valve assembly of claim 5, further characterized by: said ring having a pair of connecting portions for each spring seat segment which extend edgewise axially from the circumferentially opposite ends of the spring seat segment and connect it with its circumferentially adjacent deflector segments and each of which extends edgewise radially substantially entirely across said annular space to cooperate with its spring seat segment in constraining liquid flowing in said inward direction in said annular space to flow towards said circumferentially adjacent deflector segments for deflection by them.

8. The valve assembly of claim 7 wherein each of said connecting portions of the ring has an axially extending radially outer edge wherein there is a radially outwardly opening notch which is intermediate the respective planes of the spring seat segments and the deflector segments and wherein said tabs are receivable to enable the ring to be inserted axially into said cylindrical wall in an orientation in which the spring seat segments are between said tabs and rotated to an orientation in which those segments are engaged with the tabs.

9. A valve assembly for normally sealing a keg, of the type cooperable with a detachable tapping coupler that provides for drawing liquid from the keg and admitting pressure gas into it, said valve assembly comprising an annular valve body detachably securable in an outwardly projecting neck on a keg, an annular gas valve member cooperable with the valve body to define an annular gas passage and movable in inward and outward directions respectively from and toward an engagement with the valve body that seals the gas passage, a siphon tube through which liquid passes out of the keg and which has an axis that coincides with axes of the valve body and the gas valve, said siphon tube being secured to said gas valve member and projecting in said inward direction therefrom, a coiled spring surrounding the siphon tube to bias the gas valve member in said outward direction, and a cylindrical spring retainer wall which surrounds the spring in coaxial radially spaced relation to the siphon tube and which has an outer end that is fixed to said valve body and an opposite inner end on which there are a plurality of coplanar, circumferentially spaced, radially inwardly projecting tabs for receiving the reaction force of said spring, said valve assembly being characterized by:

a ring

A. having a plurality of circumferentially spaced apart spring seat segments, one for each of said tabs, each said segment
   (1) having a circumferential magnitude at least equal to that of its tab,
   (2) having a radial magnitude substantially equal to the distance between the siphon tube and said cylindrical wall, and
   (3) being confined between its tab and said spring to serve as a seat for the spring and to be maintained engaged with its tab under the reaction force of the spring;

B. said ring further having a plurality of deflector segments
   (1) which alternate around the ring with said spring seat segments,
   (2) which are in such axially offset relation to the spring seat segments as to be spaced in said inward direction from said inner end of the cylindrical wall, and
   (3) each of which extends radially from the siphon tube across the space between it and said cylindrical wall, whereby liquid forced through said gas passage and flowing in said inward direction in said annular space during filling of a keg in which the valve assembly is installed is deflected into flow across said inner end of the cylindrical wall in directions substantially radial to said axes; and C. said ring further having a pair of connecting portions for each spring seat segment extending axially from the circumferentially opposite ends of the spring seat segment and connecting it with its circumferentially adjacent deflector segments, each said connecting portion extending substantially entirely across said space to cooperate with its spring seat segment in constraining liquid flowing in said inward direction in said space to flow towards the circumferentially adjacent deflector segments for deflection by them.

10. The valve assembly of claim 9 wherein said spring seat segments are uniform with one another, are spaced apart at uniform circumferential intervals, and are substantially flat and coplanar; and wherein said deflector segments are likewise uniform, substantially flat, and coplanar with one another.

11. A spring retainer for a valve assembly of the type whereby a keg is normally sealed and to which a tapping coupler is detachably connectable to provide for drawing liquid from the keg and admitting pressure gas into it, said valve assembly comprising an annular valve body detachably securable in an outwardly projecting neck on a keg, an annular gas valve member cooperating with the valve body to define an annular gas passage and movable in inward and outward directions respectively from and to an engagement with the valve body that seals the gas passage, a siphon tube through which liquid passes out of the keg and which is coaxially secured to the gas valve member and projects in said inward direction therefrom, and a coiled spring surrounding the siphon tube to bias the gas valve member in said outward direction for said engagement, said spring retainer being formed in one piece and comprising a cylindrical wall having an axis, an outer end, and an opposite inner end, means on said outer end of said wall for detachably securing the spring retainer to said valve body with said cylindrical wall surrounding the spring in coaxial radially spaced relation to the siphon tube, and a radially inwardly projecting circumferential flange on said inner end of the cylindrical wall providing abutment means for engagement by the spring to support the reaction thereof, said spring retainer being characterized by:

A. said flange having circumferentially spaced deflector portions, each of which
   (1) extends circumferentially around a portion of the flange,
   (2) is of such radial magnitude as to extend substantially entirely across the annular space between the siphon tube and the cylindrical wall, and
   (3) defines a deflecting surface that faces axially towards said outer end of the cylindrical wall and lies substantially in a plane normal to said axis of the cylindrical wall; and B. said spring retainer having at said inner end of its cylindrical wall an elongated aperture for each said deflector portion, each said aperture
   (1) extending lengthwise around a portion of the circumference of said cylindrical wall,
   (2) having one longitudinal edge defined by the deflector portion for the aperture, and
   (3) having an opposite longitudinal edge on said cylindrical wall which is spaced from and opposes the deflecting surface on its deflector portion and across which liquid flowing in said inward direction in said annular space is deflected by that deflecting surface, to issue from the aperture as a sheet-like jet that is substantially parallel to said plane.

12. The spring retainer of claim 11, further characterized by:

C. said cylindrical wall having a pair of elongated holes therethrough for each of said apertures, each of which holes extends lengthwise around a part of the circumference of that wall,
   (1) one hole of the pair being near said outer end of the cylindrical wall and
   (2) the other hole of the pair being intermediate that one hole and the aperture for the pair, and
   (3) each of said holes of the pair being axially aligned with the aperture for the pair.

* * * * *

UNITED STATES PATENT AND TRADEMARK OFFICE

CERTIFICATE OF CORRECTION

PATENT NO. : 4,685,598

DATED : August 11, 1987

INVENTOR(S) : James E. Nezworski

It is certified that error appears in the above-identified patent and that said Letters Patent is hereby corrected as shown below:

Column 11, line 39, delete "outward" and insert --inward--.

Column 11, line 45, delete "inward" and insert --outward--.

Signed and Sealed this

Twenty-ninth Day of December, 1987

*Attest:*

DONALD J. QUIGG

*Attesting Officer*

*Commissioner of Patents and Trademarks*